United States Patent [19]

Looney

[11] 4,037,832

[45] July 26, 1977

[54] SORTER APPARATUS

[75] Inventor: John Howard Looney, Fairport, N.Y.

[73] Assignee: Xerox Corporation, Stamford, Conn.

[21] Appl. No.: 706,727

[22] Filed: July 19, 1976

[51] Int. Cl.[2] ..... B65H 31/26

[52] U.S. Cl. ..... 271/173; 271/180

[58] Field of Search ..... 271/173, 177, 180, 181, 271/220–224

[56] References Cited

U.S. PATENT DOCUMENTS

| | | | |
|---|---|---|---|
| 3,633,479 | 1/1972 | Bergstrom | 271/181 |
| 3,802,694 | 4/1974 | Post et al. | 271/173 UX |

FOREIGN PATENT DOCUMENTS

| | | | |
|---|---|---|---|
| 282,245 | 12/1913 | Germany | 271/181 |

*Primary Examiner*—Robert W. Saifer

[57] ABSTRACT

A multi-bin sorter comprised of a vertical array of bins movable to bring individual bins selectively into operative disposition with a sheet discharge station. The vertically oriented bins are advanced intermittently to selectively raise and lower the bins to bring each individual bins into and out of operative juxtaposition with the discharge station where a sheet is directed into the appropriate bin. Trial edge hold down apparatus including fingers positioned at the station hold down the trailing edges of previously received sheets at the point of sheet inlet to facilitate the sorting operation and prevent a jam.

1 Claim, 2 Drawing Figures

SORTER APPARATUS

This invention relates to an improved sorting system, and more particularly, to an improved sheet handling apparatus facilitating the distribution of sheets into sorter bins.

With the advent of higher speed and more sophisticated copy producing machines, printing presses, and the like, considerations as to how the mass of copies generated can best and most effectively be handled has assumed increasing importance. One way has been to provide a sorter at the machine output, the sorter serving to place the copies in accordance with a selected program in various bins of the sorter. While sorters as known to the art have taken various and sundry forms, many suffer from an inability to provide or permit a relatively uninterrupted operational system. This is in the sense that the feed of sheets to the sorter must be interrupted when the sorter bins or trays start to fill and jams can occur. Where, for example, the source of sheets to be sorted is a relatively high speed copying machine, the machine must be stopped during this period with attendant loss in production time.

It is therefore a principal object of the present invention to provide a new and improved sorting or collating apparatus.

It is a further object of the present invention to provide an improved sorter for sheets, capable of receiving sheets to be sorted without incurring damage to the sheets as they enter a particular bin.

It is an object of the present invention to provide a sorter with apparatus capable of holding down edges of previously received sheets in a bin to facilitate entry of the next incoming sheet.

This invention relates to a sorting apparatus for sheet material received in succession at a sheet receiving station, comprising in combination a series of individual bins having an inlet for receiving individual sheets moved past a sheet receiving station; and trail edge hold down apparatus at the station adapted when actuated to hold down the trail edges of previously received sheets in a bin receiving the next incoming sheet.

Figure 1:
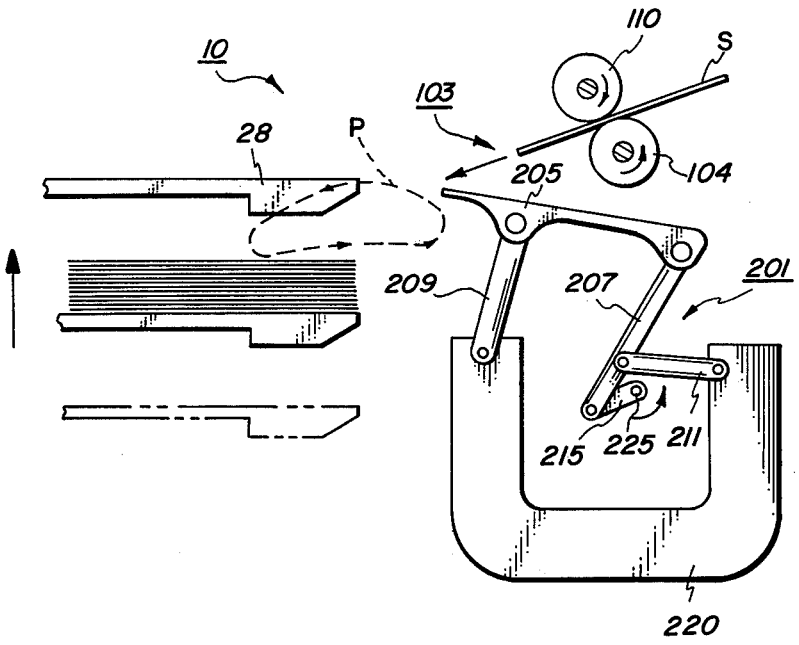
Figure 2:
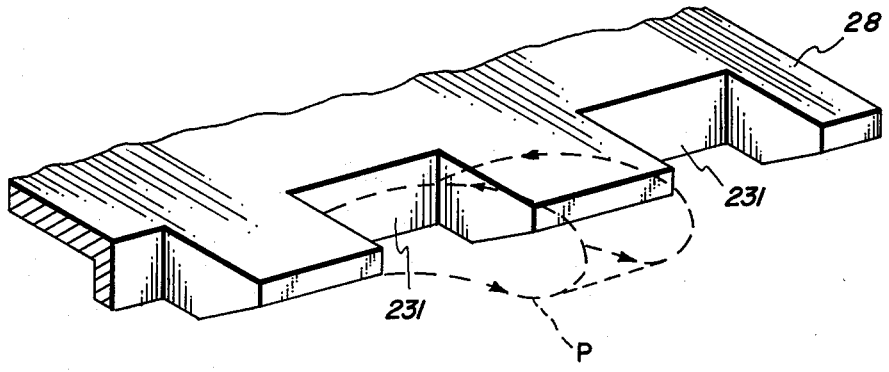

Other objects and advantages will be apparent from the ensuing description and drawings in which:

FIG. 1 is a side view schematic of a sorting system incorporating the trail edge hold apparatus of the present invention; and FIG. 2 is a partial isometric view of the inlet of a bin illustrating certain details thereof.

Referring particularly to FIG. 1 of the drawings, the sorter of present invention thereshown is designated generally by the numeral 10. A typical sorter of this type is described in U.S. Pat. No. 3,561,745 to Gaffron et al. Sorter 10 forms an integral part of an on-line finishing system which includes a source of sheets to be sorted, such as a copier or duplicator (not shown), a sorter loading station 103 including transport rolls 104 and 110 for transporting sheets S to be sorted from the copier to sorter 10. Sorter 10 comprises a series of discreet sheet receiving bins 28 supported for substantially vertical up and down movement. As a result, the individual bins 28 are brought into operative juxtaposition with the outlet of loading station 103.

In accordance with the present invention, trail edge hold down apparatus 201 comprises a plurality of fingers 205 which are pivotally connected to position links 207 and 209. Links 207 are positioned by links 211 and driven by links 215. Links 209 and 211 are pivotally fixed at one end to a frame 220. Link 215 is driven in the direction of the arrow on an axis 225 to effect a rotary movement.

It will be noted in FIG. 2 that bins 28 are formed with notches 231 to receive fingers 205 when movement is imparted thereto.

In operation bins 28 are moved intermittently in a vertical direction past the sheet delivery zone where a sheet S is advanced in each bin by transport rolls 104 and 110 in a manner well known by those skilled in the art. The drive for links 215 is such that the timing coincides with the arrival of sheet S into the appropriate tray such that the fingers 205 are directed through the notches 231 just prior to the arrival of the sheet. It will be appreciated that by virtue of the path P of fingers 205 as best shown in FIG. 1 that the fingers will contain the trailing edges of the previously delivered sheets thus facilitating the insertion of the next incoming sheet. Upon continued movement of the fingers 205 it will be noted that as the fingers disengage from the stack of sheets that the fingers lift slightly as they are retracted which preclude distrubing the stack. The fingers then assume the starting or rest position as shown in FIG. 1 and the cycle is repeated with each succeeding bin.

While the invention has been described with reference to the structure disclosed, it is not confined to the details set forth, but is intended to cover such modifications or changes as may come within the scope of the following claims.

What is claimed is:

1. An improved sorting apparatus comprising:

a frame;

a vertical array of close-spaced horizontally extending parallel bin members movably supported on said frame and adapted to move past said loading station for receiving a sheet, means for moving said bin members relative to said loading station;

conveyor means at a loading station for directing sheets into a selected bin member as the bin members are moved relative thereto; and trail edge hold down means at said loading station adapted when actuated to the moved from a first position outside the bin path to a second position inside the bin path in contact with a stack of previously received sheets of the bin coincident with said bin receiving the next incoming sheet to facilitate entry thereof;

wherein said trail edge hold apparatus include a plurality of finger members actuated by a drive linkage to move in crank fashion;

wherein the continued movement of said fingers returning towards their starting position lifts them away from said stack.

* * * * *